US005333041A

United States Patent [19]

Ito et al.

[11] Patent Number: 5,333,041

[45] Date of Patent: Jul. 26, 1994

[54] IMAGE FORMING APPARATUS FOR COLLECTING TONER WITH THE DEVELOPING ROLLER

[75] Inventors: Katsuyuki Ito; Toshiro Murano; Masato Sakai; Toru Ishihara, all of Tokyo, Japan

[73] Assignee: Oki Electric Industry Co., Ltd., Japan

[21] Appl. No.: 47,324

[22] Filed: Apr. 15, 1993

[30] Foreign Application Priority Data

May 13, 1992 [JP] Japan ..... 4-120253

[51] Int. Cl.[5] ..... G03G 21/00

[52] U.S. Cl. ..... 355/270; 355/297

[58] Field of Search ..... 355/296, 297, 299, 301, 355/303, 269, 270

[56] References Cited

U.S. PATENT DOCUMENTS 5,023,666 6/1991 Shimazaki et al. ..... 355/269
5,055,882 10/1991 Fushimi ..... 355/269
5,119,138 6/1992 Oda et al. ..... 355/269
5,124,757 6/1992 Ikegawa ..... 355/269
5,200,789 4/1993 Oshiumi ..... 355/296
5,231,456 7/1993 Kikuchi et al. ..... 355/270

*Primary Examiner*—A. T. Grimley
*Assistant Examiner*—Nestor R. Ramirez
*Attorney, Agent, or Firm*—Panitch Schwarze Jacobs & Nadel

[57] ABSTRACT

An image forming apparatus for collecting, through a developing device, and reusing remaining toner remained on a photosensitive drum, as an image carrier, for forming an electrostatic latent image, without being transferred to a transfer material, includes a toner uniforming member disposed between locations for a charging process and for an exposing process, for making the toner remained on the photosensitive drum during a transferring process adhere slightly and uniformly to the photosensitive drum. The toner uniforming member eliminates the remaining toner remained on the photosensitive drum temporarily, and is applied with a necessary voltage for making the remaining toner eliminated temporarily adhere to the surface of the photosensitive drum again.

5 Claims, 2 Drawing Sheets

IMAGE FORMING APPARATUS FOR COLLECTING TONER WITH THE DEVELOPING ROLLER

BACKGROUND OF THE INVENTION

1. Field of the Invention

This invention relates to an image forming apparatus as an electrophotographic printer for printing an image using dry developer.

2. Description of Related Art

Such a conventional image forming apparatus typically forms an image through processes of charging a surface of its photosensitive drum uniformly, exposing the surface of the photosensitive drum to light for writing in order to form an electrostatic latent image, forming a toner image by clinging toner onto the electrostatic latent image, transferring the toner image to a transfer material such as a printing paper, fixing the transferred toner image onto the transfer material, and cleaning for eliminating the remaining toner, not transferred to the transfer material during the transferring process, from the surface of the photosensitive drum. There has been known an example in which a discharging process is provided for preventing the surface of the photosensitive drum from being formed with a remanent image after the transferring process before the charging process.

During the cleaning process of the conventional electrophotographic process described above, an elastic rubber blade is pushed to contact with the photosensitive drum to scratch and collect the remaining toner on the surface of the photosensitive drum mechanically. The toner collected during the cleaning process is stored in a waste toner container located within an electric photoconductor cartridge (hereinafter called "EP cartridge"), and is disused at the same time that the EP cartridge is exchanged after serving its time.

However, in this case, it is difficult to make the EP cartridge compact since the EP cartridge has to store the collected toner in the waste toner container located within the EP cartridge. Additionally, it is not preferable in terms of environmental protection since the collected toner will be discarded.

In another image forming apparatus, therefore, the toner remaining on the photosensitive drum is collected by a developing device itself, for instance, by a developing roller in the developing device, in lieu of the cleaning device, and the toner thus collected is reused.

However, the image forming apparatus in which the toner is collected by the developing roller composing the developing device to be reused, does not collect the toner adequately in the case that the remaining toner remains much on the photosensitive drum due to an insufficient transfer, and a positive remanent image occurs on the transfer material as stains. This is because during the developing process after the processes of charging and exposing, the apparatus collects the toner remained during the transferring process on the photosensitive drum.

When a light source such as a laser, an LED (Light Emitting Diode) array, or the like exposes the surface of the photosensitive drum serving with the remaining toner, the surface of the photosensitive drum, even if the surface should be exposed, is exposed inadequately by a photo-shielding effect caused by particles of the remaining toner on the surface of the photosensitive drum, so that a necessary electrostatic latent image may not be formed. In such a case, since an adequate or perfect electrostatic latent image is not formed due to shortage of the exposure, the toner does not adhere adequately to the photosensitive drum during the developing process, and a negative remanent image occurs due to shortage of density of the toner.

SUMMARY OF THE INVENTION

It is an object of the invention to provide an image forming apparatus in which a positive remanent image and a negative remanent image are not formed on a photosensitive drum thereof even in the case that a toner remained during a transferring process on the photosensitive drum is collected to be reused during a developing process.

It is another object of the invention to provide an image forming apparatus in which light emitted from a light source thereof during an exposing process is not shielded by a toner remained on a photosensitive drum thereof.

It is yet another object of the invention to provide an image forming apparatus capable of adequately collecting, during a developing process, a toner remained during a transferring process on a photosensitive drum.

The foregoing objects are accomplished with an image forming apparatus in which a toner uniforming member for making toner, which is remained on a photosensitive drum thereof during a transferring process, adhere uniformly, lightly to the photosensitive drum, is disposed between devices for charging and for exposing, and in which the toner uniforming member collects the remaining toner temporarily and then a necessary voltage is applied to the toner uniforming member so that the collected toner adheres to the surface of the photosensitive drum again. The image forming apparatus thus constructed is able to prevent the light, emitted from a light source during an exposing process, from being shielded by the toner remaining on the photosensitive drum, and prevents the photosensitive drum from being formed with a positive remanent image and a negative remanent image even if the toner remaining on the photosensitive drum is collected during a developing process and reused.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
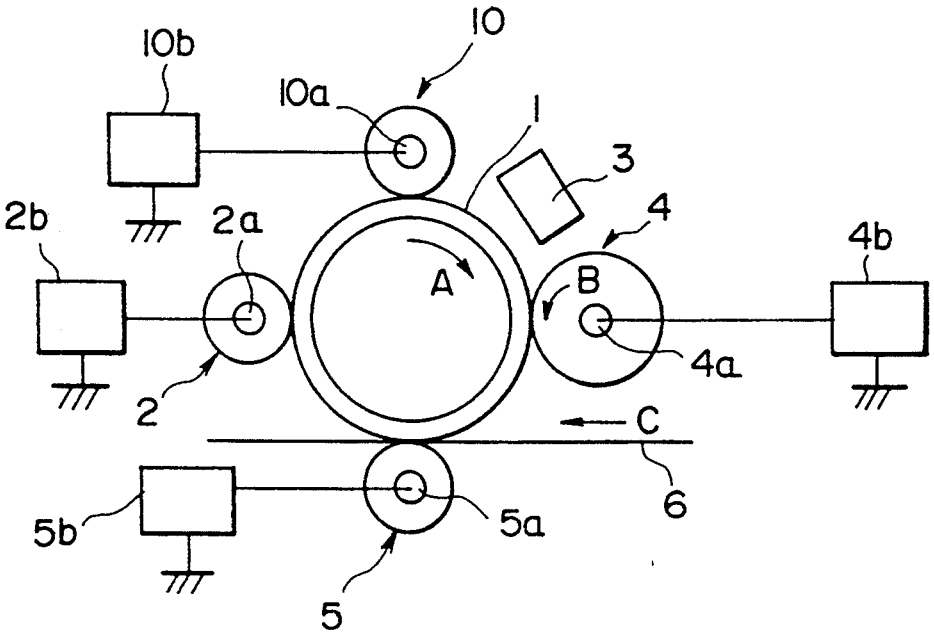
FIG. 1 is a schematic illustration showing an image forming apparatus according to a preferred embodiment of the invention.
Figure 2:
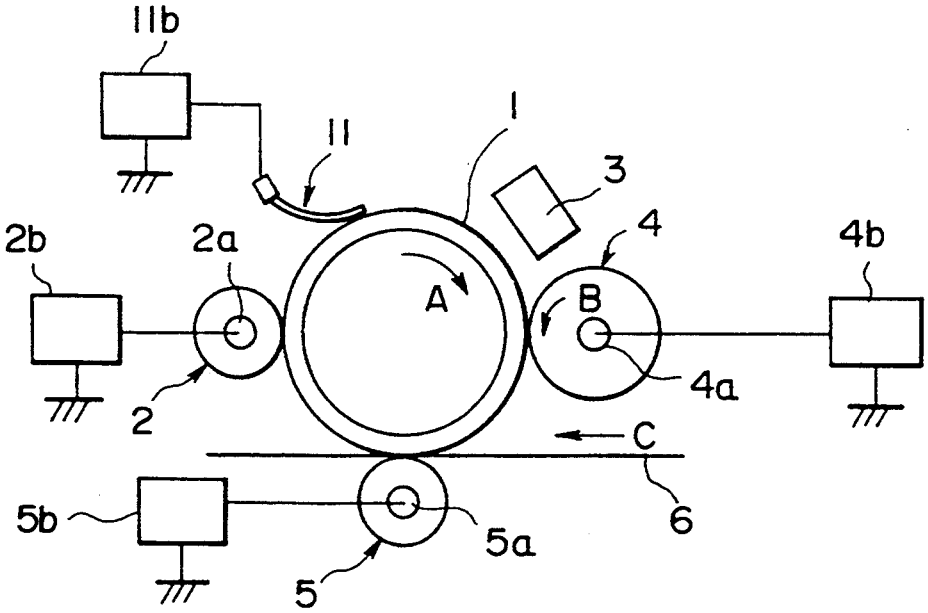
FIG. 2 is a schematic illustration showing an image forming apparatus according to another preferred embodiment of the invention.
Figure 3:
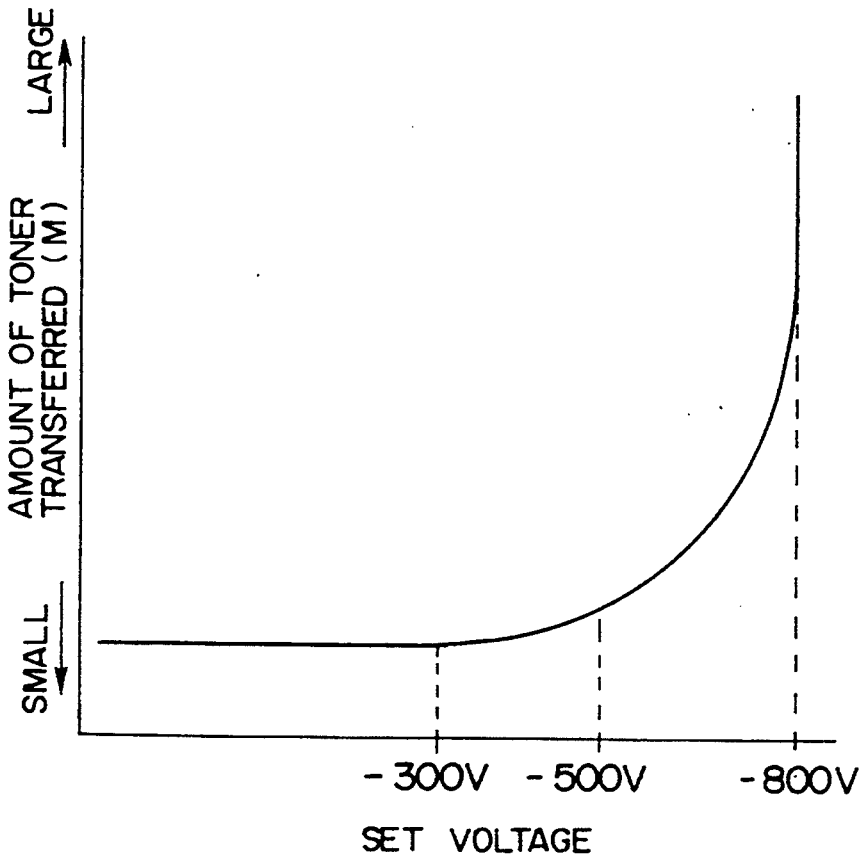
FIG. 3 is a diagram showing a relation between set voltage and amount of toner transferred.

Referring to FIGS. 1 to 3, preferred embodiments of the invention will be explained. FIG. 1 shows an illustration of an image forming apparatus according to a first embodiment of the invention.

In FIG. 1, the numeral 1 is a photosensitive drum as an image carrier. The photosensitive drum 1 is formed in a cylindrical shape with negatively charged photosemiconductor, such as an organic photoconductor (OPC) or the like, arranged at its surface, and rotates in a direction indicated by arrow A in the drawing. The numeral 2 is a charging roller as a charging device for uniformly charging the surface of the photosensitive drum 1. The charging roller 2 is formed of conductive rubber, contacting to the photosensitive drum with a predetermined pressure, and being driven in accordance with the rotation of the photosensitive drum 1. The charging roller 2 can be driven by the rotation of the photosensitive drum 1, or else the charging roller 2 can rotate by itself by drive force from a drive source not shown.

As a charging device, not only the charging roller 2, but also a contact type charger such as a brush or the like, or a non-contact type charger such as a corona discharge charger utilizing corona discharge, can be used. Although the charging roller 2 has its electric resistance of $10^5$ (ohm) in this embodiment, a material having the electric resistance in a range from $10^0$ to $10^9$ can be used for the charging roller 2. The electric resistance is defined by a resistance between a conductive shaft 2*a* and a portion at which the charging roller 2 and the photosensitive drum 1 are contacted with each other, or a portion defined by a nip width multiplied by a length in a longitudinal direction of the charging roller. The numeral 2*b* is a power supply source for supplying a voltage to the conductive shaft 2*a*.

The numeral 3 is a photo-writing device for forming an electrostatic latent image on the surface of the photosensitive drum 1 by emitting light onto the surface of the photosensitive drum. Although in this embodiment the photo-writing device 3 uses an LED array in which a plurality of LEDs are arranged in an array shape as a light source, it can use a laser beam scanning device, a liquid crystal shutter array, and the like.

The numeral 4 is a developing roller for carrying toner, disposed within a developing device. The developing roller 4 contacts to the photosensitive drum 1 with a predetermined pressure, and rotates in a direction indicated by arrow B in the drawing. The developing roller 4 of this embodiment is a conductive rubber roller, whose electric resistance is $10^6$ (ohm). A material of electric resistance in a range from $10^0$ to $10^9$ (ohm) approximately, can be used as the developing roller 4. The electric resistance of the developing roller 4 is defined, as well as that of the charging roller 2, by an electric resistance between a portion at which the developing roller 4 and the photosensitive drum 1 are contacted with each other and a conductive shaft 4*a*.

Developing material, or toner, formed in a thin film of its thickness of about 50 to 60 micron meter on the developing roller 4 by means not shown, enters a developing region at which the developing roller 4 and the photosensitive drum 1 contact with each other in accordance with the rotation of the developing roller 4, and a developing process is performed thereat. The toner is charged at the same polarity to the photosensitive drum 1. The toner adheres to a portion of the photosensitive drum 1 exposed by the photo-writing device 3, thereby being used for a reversal development. The numeral 4*b* is a power supply source for supplying a voltage to the conductive shaft 4*a*. By the power supply source 4*b*, an intermediate potential between the potential of the image part of the photosensitive drum 1 and the potential of the non-image part of the photosensitive drum 1, is applied to the developing roller 4 as a bias voltage for development.

The numeral 5 is a transferring roller as a transferring device. The transferring roller 5 transfers the toner image on the photosensitive drum 1 onto the transfer material 6 such as a printing paper and the like conveyed in a direction indicated by arrow C in the drawing. The transferring roller 5 contacts to the photosensitive drum 1 with a predetermined pressure, and is driven according to the rotation of the photosensitive drum 1. Although the transferring roller 5 of this embodiment uses its electric resistance of $10^8$ (ohm), a material of electric resistance in a range from $10^0$ to $10^9$ (ohm) approximately, can also be used. The electric resistance of the transferring roller 5 is defined, as well as that of the charging roller 2, by an electric resistance between a portion at which the transferring roller 5 and the photosensitive drum 1 are contacted with each other and a conductive shaft 5*a*. The numeral 5*b* is a power supply source for supplying a voltage to the conductive shaft 5*a*.

The transfer material 6 to which the toner image is transferred by the transferring device, is separated from the photosensitive body, and is conveyed to a fixing device not shown. After finishing a fixing process, the material 6 is ejected out of the image forming apparatus as a printed material.

The numeral 10 is a cleaning roller for cleaning the toner remaining on the photosensitive drum 1 from the photosensitive drum 1 after the completion of the charging process for uniformly charging the surface of the photosensitive drum 1 with the charging roller 2. The cleaning roller 10 contacts to the photosensitive drum 1 with a predetermined pressure, and is driven according to the rotation of the photosensitive drum 1. Although the cleaning roller 10 is formed of a semi-conductive foamed urethane sponge, the cleaning roller 10 can also be formed of a semi-conductive rubber material, for example such as, a silicon rubber containing conductive carbon. Although the cleaning roller 10 of this embodiment uses its electric resistance of $10^5$ (ohm), a material of electric resistance in a range from $10^0$ to $10^9$ (ohm) approximately, can also be used. The electric resistance of the cleaning roller 10 is defined, as well as that of the charging roller 2, by an electric resistance between a portion at which the cleaning roller 10 and the photosensitive drum 1 are contacted with each other and a conductive shaft 10*a*. The numeral 10*b* is a power supply source for supplying a voltage to the conductive shaft 10*a*. Control means not shown controls a voltage supplied to the conductive shaft 10*a*.

In this embodiment, the photosensitive drum 1, the cleaning roller 10, and the developing roller 4 are adjusted to be charged at the following voltages. The photosensitive drum 1 is charged at −800 (V) by the charging roller 2. The cleaning roller 10 is applied with −500 (V) by the power supply source 10*b*. The developing roller 4 is applied with −300 (V) by the power supply source 4*b*.

Now, the transferring roller 5 is applied with a voltage of around +2,000 (V) from a power supply source 5*b*. During the transferring process, therefore, the toner on the photosensitive drum 1 is attracted to the transferring roller 5 by an electric effect, thereby being adsorbed by the transfer material 6, and thereby being transferred. After transferred, the toner being not transferred to the transfer material and remaining on the photosensitive drum 1 may be charged positively by receiving electron charges from the transferring roller 5 through the transfer material 6 at a time that the voltage for transferring is high. The polarity and amount of electron charges of the toner not transferred to the transfer material 6 and remained on the photosensitive drum 1, vary according to the type of the transfer material 6 and the change of environment. The remaining toner, however, is charged negatively as well as the photosensitive drum 1 by the effect from the charging roller 2 when passing the charging roller 2 even if charged positively.

The voltage applied to the cleaning roller 10 is set at −500 (V), whereas the surface potential of the photosensitive drum 1 is set at −800 (V). Accordingly, the cleaning roller 10 attracts the toner charged negatively on the photosensitive drum 1 by Coulomb force, and cleans the photosensitive drum 1.

Specifically, the voltage applied to the cleaning roller 10 is set at −500 (V), and is set so that it is nearer to the surface potential of the photosensitive drum 1 of −800 (V) than the voltage applied to the developing roller 4 of −300 (V). As shown in FIG. 3, amount of toner transferred by applied voltage is changed linearly according to change of the voltage. As shown apparently in FIG. 3, the amount of the transferred toner is almost unchanged at the set voltage in a range from 0 (V) to −300 (V), and gradually increases at the set voltage in a range from −300 (V) to −500 (V). The amount of the transferred toner is almost saturated around −800 (V). That is, where the set voltage is near the surface potential of the photosensitive drum 1, intensity of the electric field becomes weak as the potential difference between them becomes small, so that the toner easily moves up on the photosensitive drum 1. The toner on the cleaning roller 10 also move up on the photosensitive drum 1, since the bias voltage for the cleaning roller 10 is −500 (V) and near to the surface potential of the photosensitive drum 1. Accordingly, although the toner negatively charged uniformly by the charging roller 2 is almost eliminated from the photosensitive drum 1 to the cleaning roller 10 by Coulomb force temporarily as described above, as the amount of electron charges increases due to friction or the like between the cleaning roller 10 and the photosensitive drum 1 according to rotation of the photosensitive drum 1, the voltage of the toner collected on the cleaning roller 10 approaches nearer to the set voltage (−800 V) of the photosensitive drum 1 than the voltage of the toner at a time right after the toner is attracted by the cleaning roller 10. Therefore, according to the rotation of the cleaning roller 10, a transfer phenomenon in which the toner gathered temporarily on the cleaning roller 10 moves up on the photosensitive drum 1 begins to occur, so that the toner on the cleaning roller 10 is gradually returned to the photosensitive drum 1 little by little.

As a result, the toner does not adhere heavily to the photosensitive drum 1 passed over the cleaning roller 10, but adheres slightly, uniformly and flatly without unevenness. Therefore, no clod of the toner on the photosensitive drum 1 adheres to the photosensitive drum 1 passed over the cleaning roller 10, so that the toner does not shield the light for writing, when the photo-writing device 3 forms an electrostatic latent image on the photosensitive drum 1. Moreover, although the developing roller 4 makes the toner adhere to an exposed portion corresponding to the electrostatic latent image formed on the photosensitive drum 1, the toner remained at an unexposed portion is attracted to the developing roller 4 by the voltage difference between the surface potential of the photosensitive drum 1 of −800 (V) and the voltage of −300 (V) applied to the developing roller 4 and is collected. At that time, since the remaining toner adheres to the photosensitive drum 1 slightly and uniformly as described above, the toner is certainly collected to the developing roller 4.

Referring to FIG. 2, an image forming apparatus according to a second embodiment of the invention is shown. In FIG. 2, the numeral 1 is a photosensitive drum: the numeral 2 is a charging roller: the numeral 3 is a photo-writing device: the numeral 4 is a developing roller: the numeral 5 is a transferring roller 5: the numeral 6 is a transfer material: the numerals 2*a*, 4*a*, 5*a* are conductive shafts: the numerals 2*b*, 4*b*, 5*b* are power supply sources. Since these elements basically have the same structures to those of the embodiment described above, a detailed explanation for this embodiment is omitted.

The numeral 11 is a blade as a toner uniforming member for making the toner, which is not transferred onto the transfer material during a transferring process and is remained on the photosensitive drum 1, adhere onto the photosensitive drum 1 slightly and uniformly. In this second embodiment, the toner uniforming member is constituted of the blade 11, whereas it is constituted of the roller in the first embodiment.

The blade 11 is disposed on a downstream side of the charging roller 2 with respect to the rotary direction of the photosensitive drum 1, and, in other words, it is disposed between the charging roller 2 and the photo-writing device 3. The blade 11 contacts to the photosensitive drum 1 with a predetermined pressure. The blade 11 is formed of, for example, a semi-conductive rubber material or a semi-conductive sponge material, and is applied with a voltage from a power supply source 11.

In this embodiment, the photosensitive drum 1 is charged at −800 (V) by the charging roller 2, and voltages of −500 (V) and −300 (V) are applied to the blade 11 and the developing roller 4, respectively. A negatively charged type toner is used as a toner, and a reversal development in which the photo-writing device 3 makes the toner adhere to the exposed portion is performed.

The transfer roller 5 is applied with around +2,000 (V), thereby attracting a toner image onto the transfer material 6, and thereby transferring it. After the toner image is transferred, the toner remaining on the photosensitive drum 1 may receive electron charges from the transferring roller 5 through the transfer material 6 and may be charged positively, in the case that the transfer voltage is high.

Even if the remaining toner is charged positively, the toner is charged negatively as well as the photosensitive drum 1 by the operation of the charging roller 2 when passed at the charging roller 2. The voltage applied to the blade 11 is set at −500 (V), whereas the surface potential of the photosensitive drum 1 is set at −800 (V). Accordingly, the blade 11 attracts the toner charged negatively by Coulomb force, and the toner remained on the photosensitive drum 1 is kept remained on the photosensitive drum 1 by a suppressing force from the blade 11.

The voltage applied to the blade is −500 (V), and is set about nearer to the surface potential of the photosensitive drum 1 of −800 (V) than the voltage applied to the developing roller 4 of −300 (V). The relation between the amount of the toner transferred and the set voltage is as described above. Therefore, if the set voltage is near to the surface potential of the photosensitive drum 1, the potential difference becomes small, thereby rendering the intensity of the electric field weak, so that the toner is easily transferred onto the photosensitive drum 1. In this embodiment, the toner on the blade 11 is readily transferable onto the photosensitive drum 1, since the bias of the blade 11 is set at −500 (V) and is neat to the surface potential of the photosensitive drum 1.

Consequently, although the toner negatively, uniformly charged by the charging roller 2 is eliminated from the photosensitive drum 1 temporarily, the amount of the electric charges of the toner forced to be remained by the blade 11, increases due to the friction or the like between the blade 11 and the photosensitive drum 1 in accordance with an increment of the toner forced to be remained by the blade 11, and the voltage of the toner approaches to the set voltage of the photosensitive drum 1 of −800 (V) more than the voltage at the time right after the toner is forced to be remained by the blade 11.

When the toner forced to be remained by the blade 11 increases in such a manner, since a transfer phenomenon in which the toner is transferred to the photosensitive drum 1 begins to occur, the toner forced to be remained by the blade 11 is returned onto the photosensitive drum 1 little by little. Therefore, no toner adheres heavily onto the photosensitive drum 1 after the photosensitive drum 1 passed the blade 11, and the toner adheres slightly, flatly, and averagely.

Accordingly, after the photosensitive drum 1 passes the blade 11, since no clod of the toner adheres heavily onto the photosensitive drum 1, no toner shields the light for writing at a time that the photo-writing device 3 forms an electrostatic latent image. Moreover, although the developing roller 4 makes the toner adhere to an exposed portion corresponding to the electrostatic latent image formed on the photosensitive drum, the toner remaining at an unexposed portion is absorbed to the developing roller 4 by the voltage difference between the surface potential of the photosensitive drum 1 of −800 (V) and the voltage applied to the developing roller 4 of −300 (V) and is collected. At that time, since the remaining toner adheres slightly, uniformly on the surface of the photosensitive drum 1 as described above, the remaining toner is certainly collected to the developing roller 4.

It is to be noted that although the blade 11 is used for making the toner remained after the transfer process adhere slightly, uniformly on the surface of the photosensitive drum 1, the shape of the blade and the method for contacting to the photosensitive drum 1 are not restricted to which is described above. Furthermore, although the voltage applied to the blade 11 from the power supply source **11*b* is explained as −500 (V), it is possible to control amount of toner, forced to be remained by the blade 11 and returned to the photosensitive drum 1, by controlling the voltage applied from the power supply source 11*b***.

It will be appreciated that modifications and variations of other embodiments with respect to the present invention are readily possible for those skilled in the art in accordance with the instructions within the description mentioned above and the drawings attached. The present invention is therefore not to be restricted to the description mentioned above and the drawings attached, and such other embodiments and variations are intended to be covered by the following claims.

What is claimed is:

1. An image forming apparatus comprising:

an image carrier for being formed with an electrostatic latent image;

a charging device for uniformly charging a surface of said image carrier to a necessary voltage;

a photo-writing device for forming an electrostatic latent image on said surface of said image carrier by emitting light onto said surface of said image carrier;

a developing device for making toner adhere to said electrostatic latent image on said surface of said image carrier to form a toner image;

a transferring device for transferring said toner image onto a transfer material; and a toner uniforming member, disposed on a downstream side of said charging device in a rotary direction of said image carrier and pushed toward said image carrier with a predetermined pressure, for making remaining toner adhere slightly and uniformly to said surface of said image carrier;

said developing device being adapted to contact said image carrier and to be applied with a necessary voltage for collecting the toner remaining on said image carrier;

said toner uniforming member being adapted to eliminate said toner remaining on said image carrier temporarily and to be applied with a necessary voltage for making the toner, which is remained and eliminated temporarily, adhere again to said surface of said image carrier; and said necessary voltage applied to said toner uniforming member being a negative DC voltage, the negative DC voltage having a magnitude between the voltage of the charging device and necessary voltage of the developing device.

2. An image forming apparatus as set forth in claim 1, wherein said toner uniforming member is a roller.

3. An image forming apparatus as set forth in claim 1, wherein said toner uniforming member is a blade.

4. An image forming apparatus as set forth in claim 1, wherein amount of the toner transferred from said toner uniforming member to said image carrier is variable by controlling a voltage for said toner uniforming member (Vc).

5. An image forming apparatus as set forth in claim 1, wherein said toner uniforming member attracts said remaining toner temporarily and charges the remaining toner attracted by a friction effect between the toner uniforming member and the image carrier to a voltage nearer to the charged voltage of said image carrier than a voltage of the remaining toner at a time right after the toner is attracted.

* * * * *